US010208519B2

(12) United States Patent
Van Parys

(10) Patent No.: US 10,208,519 B2
(45) Date of Patent: Feb. 19, 2019

(54) CONCEALED HINGE FOR A TURN-TILT WINDOW AND SUCH A WINDOW EQUIPPED THEREWITH

(71) Applicant: Emmanuel Van Parys, Wortegem/Petegem (BE)

(72) Inventor: Emmanuel Van Parys, Wortegem/Petegem (BE)

( * ) Notice: Subject to any disclaimer, the term of this patent is extended or adjusted under 35 U.S.C. 154(b) by 0 days.

(21) Appl. No.: 15/400,198

(22) Filed: Jan. 6, 2017

(65) Prior Publication Data

US 2017/0198509 A1 Jul. 13, 2017

(30) Foreign Application Priority Data

Jan. 7, 2016 (BE) ..... 2016/5004

(51) Int. Cl.

| | |
|---|---|
| ***E05D 15/52*** | (2006.01) |
| ***E05D 3/18*** | (2006.01) |
| ***E05D 7/00*** | (2006.01) |
| ***E05D 7/06*** | (2006.01) |

(52) U.S. Cl.

CPC ..... *E05D 15/5211* (2013.01); *E05D 3/186* (2013.01); *E05D 7/0009* (2013.01); *E05D 7/06* (2013.01); *E05D 15/5214* (2013.01); *E05D 15/5205* (2013.01); *E05Y 2600/502* (2013.01); *E05Y 2600/56* (2013.01); *E05Y 2600/63* (2013.01); *E05Y 2900/148* (2013.01)

(58) Field of Classification Search

CPC . E05D 15/52; E05D 15/5211; E05D 15/5214; E05D 2015/487; E05D 3/186; E05D 7/06

USPC ..... 292/DIG. 7; 16/360, 357, 361, 362, 367, 16/368, 370

See application file for complete search history.

(56) References Cited

U.S. PATENT DOCUMENTS 3,911,621 A * 10/1975 McHeffey ..... E05D 15/5205 49/192
3,994,093 A * 11/1976 Mayer ..... E05D 15/52 49/192
4,035,953 A * 7/1977 Bierlich ..... E05D 15/5211 49/192

(Continued)

FOREIGN PATENT DOCUMENTS

DE 24 08 967 A1 9/1975
EP 2 407 621 A2 1/2012

OTHER PUBLICATIONS

International Search Report, dated Sep. 5, 2016, from corresponding PCT application.

*Primary Examiner* — Jeffrey O'Brien
(74) *Attorney, Agent, or Firm* — Young & Thompson

(57) ABSTRACT

A concealed hinge for a turn-tilt window with a fixed frame and leaf includes of a pair of scissors with a first arm and second arm, that are connected by a central hinge and which are hingeably connected by a first end to a mounting slat that is intended to be mounted on the frame, and have a hinge at a second end for coupling to the leaf. The first arm is connected by its first end to the mounting slat with a fixed frame hinge with a peg fastened to the mounting slat and the second arm is connected by its first end to the mounting slat by a shiftable frame hinge with a peg that is shiftably affixed in a guide slot of the mounting slat, whereby in the closed situation of the scissors, the mounting slat serves as a support for the tilting movement of these scissors.

20 Claims, 8 Drawing Sheets

(56) References Cited

U.S. PATENT DOCUMENTS

| | | | | | |
|---|---|---|---|---|---|
| 4,679,352 | A * | 7/1987 | Bates | E05D 15/30 | 49/192 |
| 4,986,028 | A * | 1/1991 | Schneider | E05D 15/30 | 16/361 |
| 5,052,079 | A * | 10/1991 | Vosskotter | E05D 15/32 | 16/367 |
| 5,081,741 | A * | 1/1992 | Aumercier | E05D 15/30 | 16/238 |
| 7,484,270 | B2 * | 2/2009 | Balbo Di Vinadio | E05D 15/5211 | 16/360 |

* cited by examiner

CONCEALED HINGE FOR A TURN-TILT WINDOW AND SUCH A WINDOW EQUIPPED THEREWITH

FILED OF THE INVENTION

The present invention relates to a concealed hinge for a window with a fixed frame and a turnable leaf.

BACKGROUND OF THE INVENTION

In particular the invention relates to a concealed hinge for a turn-tilt window that can turn open around a vertical axis, and can tilt open around a horizontal axis, depending on the position of the operating handle of the window.

Such concealed hinges are mounted in a concealed way between the fixed frame and the leaf or are intended for this purpose, so that they are not visible when the window is closed.

As is known, the leaf is provided along its periphery with a sidelong leaf lip protruding outwards, whereby in the closed position of the window the leaf rests against the front of the fixed frame through the intervention of a seal, whereby the leaf lip partially overlaps the frame in the front view.

This leaf lip also covers the space between the leaf and the fixed frame in which the concealed hinges are mounted, so that they are concealed from view when the window is closed.

The leaf is turnably suspended in the frame by means of two hinges, respectively a bottom hinge and a top hinge that are mounted respectively on the bottom and top of the leaf.

The top hinge is constructed in a known way with a scissor mechanism that can be blocked with respect to the leaf to enable a turn of the leaf around a vertical axis or can be unblocked to enable the tilting of the leaf around a horizontal axis.

The bottom hinge enables both a turning movement and a tilting movement.

Conventionally a turn-tilt window is provided with fittings with fitting slats that are shiftably affixed in a fitting groove along the outer periphery of the leaf, whereby the fitting slats are shifted in the one or the other direction in the fitting groove by means of an operating handle that can be turned from the closed position to a turn or tilt position depending on whether the person wants to turn open or tilt open the window.

In the turn position of the operating handle the aforementioned scissor mechanism is blocked by the movement of the fitting slats, such that the leaf can turn open.

In the tilt position the scissor mechanism of the top hinge is unblocked such that a tilting movement of the leaf is possible. This is often realised around an axis in the section of the bottom hinge that is fastened to the leaf or by deformation of the hinge.

A disadvantage of known concealed hinges is that the horizontal axis around which the leaf can tilt is relatively far above the bottom profile of the frame of the window, which can be detrimental for low windows, for example for windows with a height that is less than 50 cm, which due to their low height only enable a limited tilting movement with a limited opening angle, because otherwise the bottom leaf lip would touch the front of the frame with its seal, such that the seal could be crushed or the leaf lip damaged.

With known concealed hinges the mounting of the leaf in the frame is relatively complicated, as in certain steps of the assembly the installer cannot see the hinges and thus has to rely on touch. This requires sufficient knowledge and skill on the part of the installer.

SUMMARY OF THE INVENTION

The purpose of the present invention is to provide a solution to one or more of the aforementioned and other disadvantages, by providing a bottom concealed hinge whose tilting axis is lower than with known hinges and which moreover is easy to mount and also provides greater protection against break-ins.

To this end the invention concerns a concealed hinge for a window with a fixed frame and a turnable leaf, whereby the concealed hinge is composed of a pair of scissors with two arms, respectively a first arm and a second arm, that are connected together by means of a central hinge and which are each connected or can be connected by a first end by means of a hinge to a mounting slat that is intended to be mounted horizontally on the fixed frame, whereby the arms are each provided on their second end with a hinge for coupling to the leaf, with the characteristic that the first arm is connected or can be connected by its first end to the mounting slat by means of a fixed frame hinge with a peg that is fastened to the mounting slat and which is intended to be mounted upright and the second arm is connected or can be connected by its first end to the mounting slat by means of a shiftable frame hinge with a peg that is provided on this first end of the second arm and which is shiftably affixed in a guide slot of the mounting slat, whereby in the closed situation of the scissors of the concealed hinge, the mounting slat serves as a support for the tilting movement of the scissors of the hinge concerned and the fixed peg on the mounting slat forms a guide for this tilting movement.

A bottom concealed hinge according to the invention provides the advantage that the leaf can hinge around a horizontal axis along a tilting edge of the mounting slat that is located in the plane of the mounting slat, and thus just above the horizontal profile of the fixed frame to which the mounting slat is fastened, which is thus much lower than usual in all respects.

As a result the opening angle of the window in its tilted position can be greater without the risk of the leaf lip at the bottom of the leaf colliding against the front of the fixed frame.

The fixed frame hinge is composed of the aforementioned fixed peg of the mounting slat and an eye on the first end of the first arm of the scissors, whereby this eye hooks over this peg.

In this way the scissors can easily be affixed on the mounting slat in the open position by hooking the eye of the fixed frame hinge at the first end of the first arm of the scissors over the peg of the mounting slat and by hooking the peg of the shiftable frame hinge at the first end of the second arm of the scissors in the guide slot of the mounting slat.

This also enables the leaf with a premounted pair of scissors on the bottom hinge to be easily coupled to a premounted mounting slat, after the opening of the scissors, as the installer has a full view of the parts of the concealed hinge that must be hooked together for the mounting of the leaf.

Preferably the peg of the mounting slat is provided at the opposite side of the tilting edge with a bend for the tilt guide of the aforementioned eye, whereby the bend essentially has a curved form with a radius of curvature with the centre on the aforementioned tilting edge of the mounting slat.

At the head of the peg a projection is preferably provided that protrudes backwards with respect to the bend.

This projection provides the advantage that in a tilted state of a mounted leaf, it is difficult to lift the leaf out of the frame by driving a wedge between the underside of the leaf and the fixed frame as is usual with a break-in.

According to a preferred characteristic the projection at the head of the peg on the mounting slat is formed by a disc that is displaced backwards eccentrically with respect to the base of this peg and this disc has a diameter that is equal to or somewhat smaller than the inside diameter of the eye.

This provides the advantage that in the vertical raised position, thus with the open scissors parallel to the plane of the mounting slat, the leaf can be mounted over the projection of the peg of the mounting slat, while the projection prevents the leaf from being unintentionally removed from the fixed frame in the tilted state.

According to another aspect of the invention, the mounting slat is constructed of two parts with a basic part that is intended to be mounted on the fixed frame and a shiftable parts with respect to this basic part that supports the aforementioned peg of the mounting slat.

As a result the sideways position of the leaf can be adjusted with respect to the frame.

To this end the mounting slat is provided with an adjuster for adjusting the position of the peg in the longitudinal direction of the basic part of the mounting slat.

According to a preferred aspect, the shiftable part of the mounting slat is provided with an end stop for the movement of the peg of the shiftable frame hinge in the guide slot in the basic part of the mounting slat when the leaf is turned open to a maximum.

As a result, the position of the peg of the fixed frame hinge and the end stop are adjusted together.

This provides the advantage that, thanks to the joint adjustment of the position of the peg and the end stop, the maximum opening angle of the window is not changed and thus an additional adjuster is not required.

This joint adjustment can of course also be applied separately to a peg and end stop, in other words independently of the specific form of the peg of the mounting plate.

The invention relates to a turn-tilt window in which this window is provided at the bottom of the leaf with at least one concealed hinge as described above, whereby the concealed hinge concerned is mounted at the bottom of the leaf and the mounting slat of this hinge is fastened to the inside of the fixed frame.

BRIEF DESCRIPTION OF THE DRAWINGS

With the intention of better showing the characteristics of the invention, a few preferred embodiments of a concealed hinge according to the invention and a turn-tilt window equipped therewith are described hereinafter by way of an example without any limiting nature, with reference to the company accompanying drawings, wherein.

DETAILED DESCRIPTION OF THE INVENTION

Figure 1:
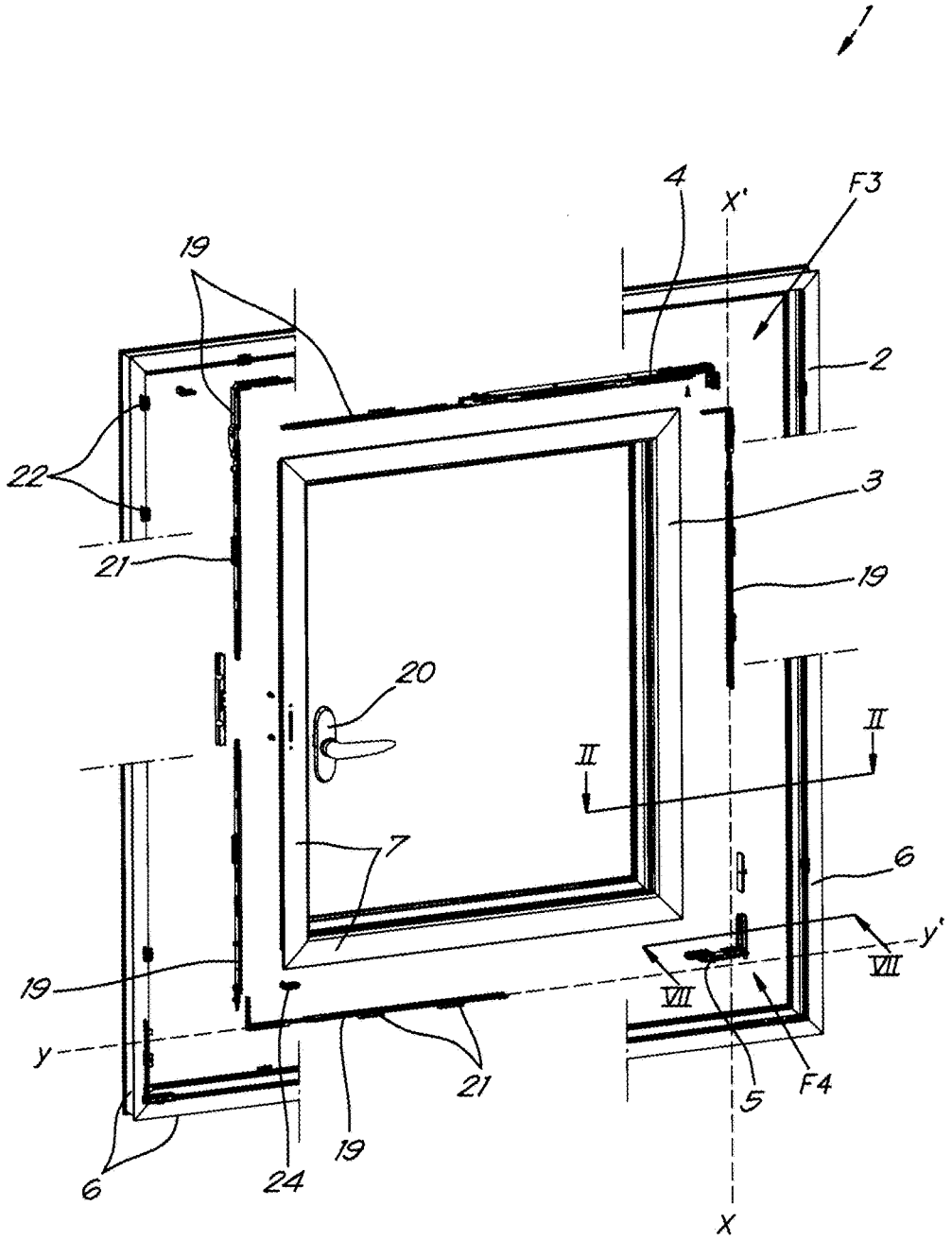
FIG. 1 schematically shows a perspective view of a partially exploded view of a turn-tilt window that is provided with a concealed hinge according to the invention.

The turn-tilt window 1 chosen as an example in FIG. 1 comprises a fixed frame 2 and a leaf 3 that is turnably and tiltably suspended in the fixed frame by means of two concealed hinges, respectively a concealed hinge 4 on the top of the leaf 3 and a concealed hinge 5 according to the invention on the underside thereof.

Figure 2:
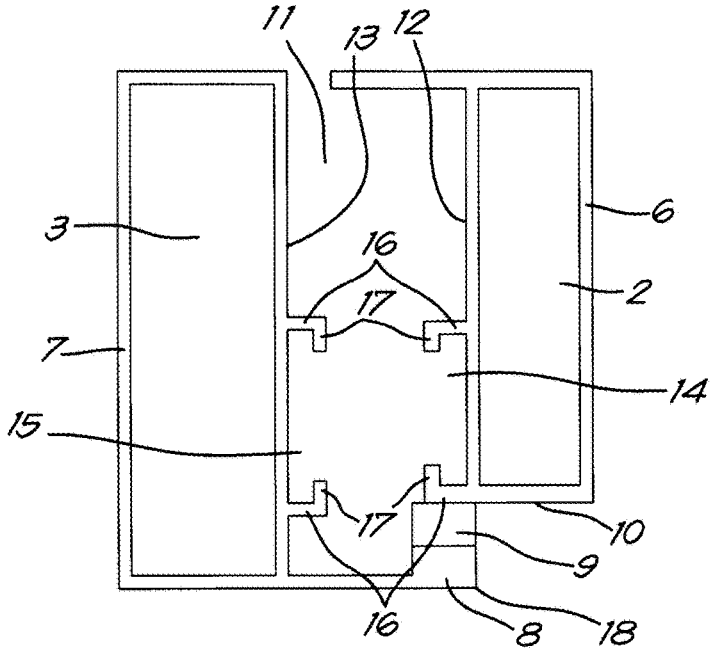
FIG. 2 shows a cross-section according to line II-II of FIG. 1, but in a simplified form.

The fixed frame 2 and the leaf 3 are constructed of profiles 6 and 7, of which the leaf profiles 7 are provided with a sideways protruding lip 8 which, due to the intervention of a seal 9, as shown in FIG. 2 in the case of a closed window, rests against the front 10 of the fixed frame 2 and partially overlaps this front 10 and also covers the gap 11 between the frame 2 and the leaf 3 in the front view.

On the sides 12 and 13 of the frame 2 and the leaf 3 oriented towards one another, respectively along the inner periphery of the frame 2 and along the outer periphery of the leaf 3, fitting grooves 14 and 15 are provided in a known way opposite one another that extend along the inner periphery of the frame 2 and along the outer periphery of the leaf 3 and which are formed by upright ribs 16 that are folded inwards perpendicularly at their free end 17.

The aforementioned concealed hinges 4 and 5 are mounted between the fitting grooves 14 and 15 on the sides 12 and of the frame 2 and the leaf 3 oriented towards one another, and are concealed from view therein behind the lip 8 when the window 1 is closed. Hence the name of concealed hinge, although this also means all separate hinges 4 and 5 that are intended to be mounted in this concealed way, without having been mounted already, however.

In the example shown the leaf 3 is also equipped with fitting slats 19 that are shiftably affixed in the fitting groove 15, and with an operating handle 20 to shift the fitting slats 19 in the one or the other direction by turning the operating handle 20.

The fitting slats 19 are provided with locking pins 21 that can engage with corresponding locking pieces 22 on the inner periphery of the frame 2 to be able to lock the window 1 in the closed position by a suitable turn of the operating handle 20.

Front, back, frontal, etc, and other directional indications are viewed from the perspective of somebody at the front of the window 1 with the operating handle 20 and who is facing the window 1.

Figure 3:
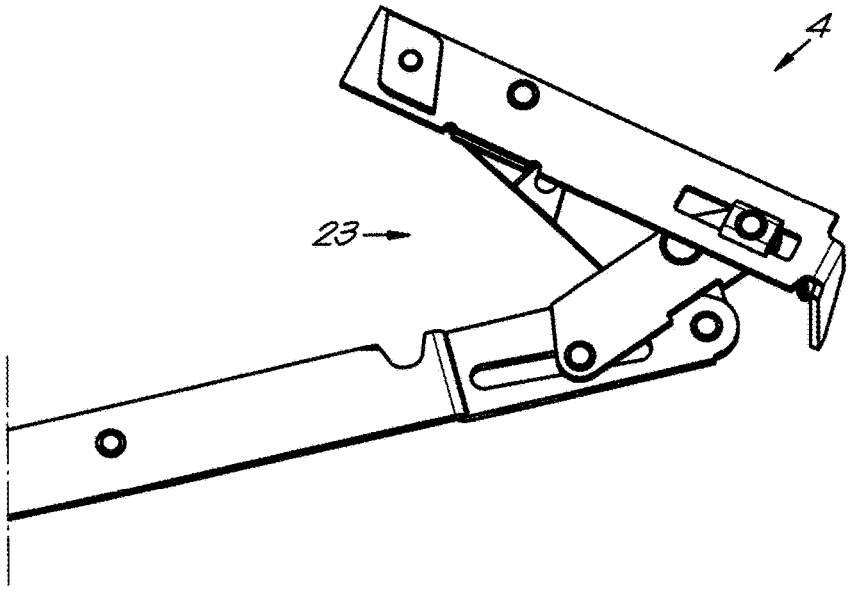
FIG. 3 shows the top hinge that is indicated by arrow F3 in FIG. 1, but in an open tilted state.

The top concealed hinge 4 is, as shown in FIG. 3, provided with a pair of scissors 23, which, as is known, is blocked in a closed position with respect to the leaf 3 by turning the operating handle 20 to a turn position.

In this turn position, the top hinge 4 can act as a hinge that, together with the bottom hinge 5, enables a turning movement of the leaf 3 around a vertical axis X-X'.

By bringing the operating handle 20 to a tilt position, the pair of scissors 23 of the top hinge 4 can be unblocked in a known way, while simultaneously an additional tilt hinge 24 is operated on the handle side of the leaf 3, whereby this tilt hinge 24 together with the bottom concealed hinge enables a tilting movement of the leaf 3 around a horizontal axis Y-Y'.

In this way, the bottom concealed hinge 5 fulfils a dual function, in the case of a turn-tilt window, i.e. that of a vertical hinge and that of a horizontal hinge, depending on whether the position of the operating handle 20 is in a turn position or a tilt position.

Figure 4:
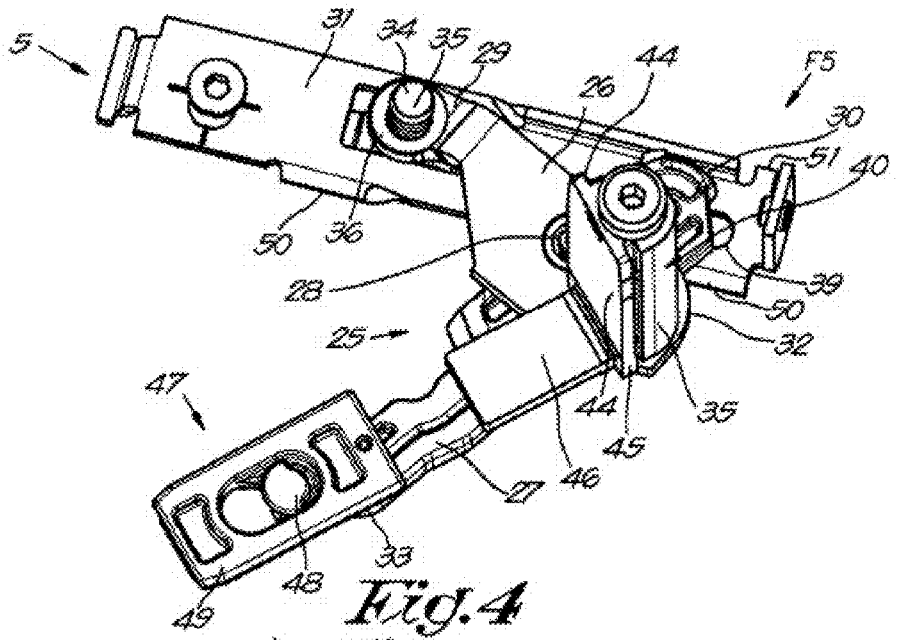
FIG. 4 shows the bottom hinge that is indicated by arrow F4 in FIG. 1, but in an open state.
Figure 5:
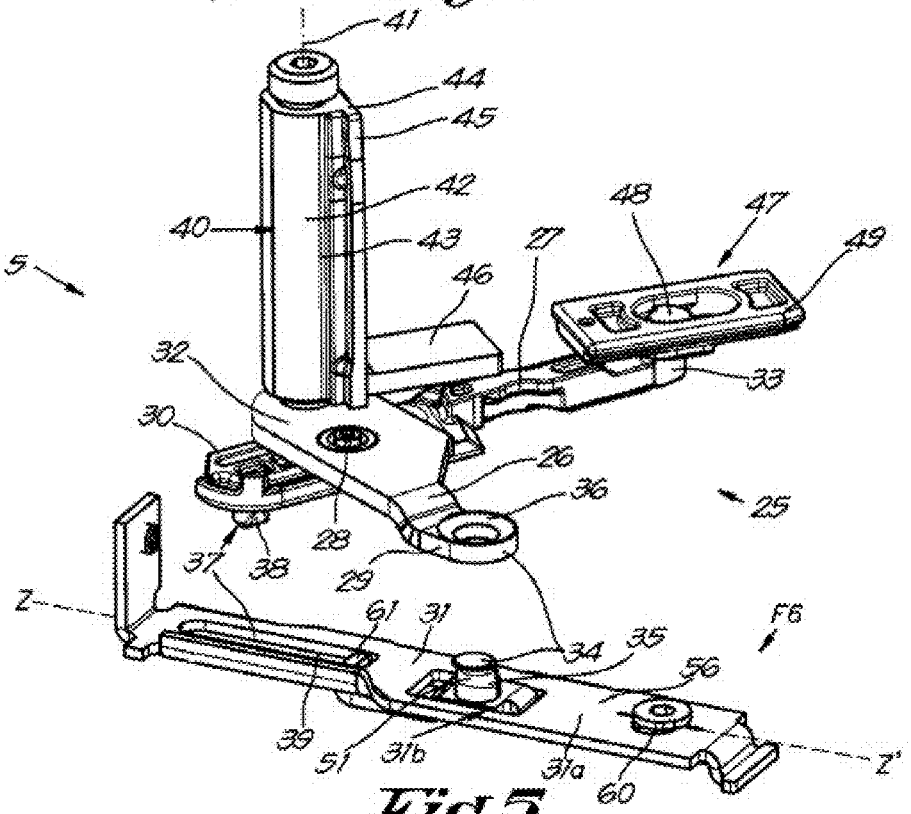
FIG. 5 shows another view of the concealed hinge of FIG. 4, but with a detached mounting slat.

The bottom concealed hinge 5 according to the invention is shown on a larger scale in FIGS. 4 and 5 and is composed of a pair of scissors 25 with two arms, respectively a first arm 26 and a second arm 27, that are connected together by means of a central hinge 28.

Both arms 26 and 27 are each connected by a first end, respectively 29 and 30, to a mounting slat 31 for the mounting of the concealed hinge 5 on the fixed frame 2, while both arms 26 and 27 are each connected by their second end, respectively 32 and 33, to the leaf 3 or are intended to be able to be connected to the leaf 3.

The first arm 26 is connected by its first end 29 to the mounting slat 31 by means of a fixed frame hinge 34 that is formed by a fixed peg 35 on the mounting slat 31 and an eye 36 affixed thereover, whereby this peg is intended to be mounted upright in the frame, more specifically in a raised a slightly inclined position.

The second arm 27 is connected by its first end 30 to the mounting slat 31 by means of a shiftable frame hinge 37 that is formed by a fixed peg 38 on the first end 30 of the second arm 27 and is shiftably affixed in a guide slot 39 of the mounting slat 31 that extends essentially along the longitudinal direction Z-Z' of the mounting slat 31.

The second end 32 of the first arm 26 is provided with a fixed leaf hinge 40 that is intended to be mounted on the leaf 3 in a fixed position and which is formed by a shaft 41 that is fixed on the first arm 26 and around which an L-shaped fastening body 42 is hingeably affixed by its vertical limb 43.

Figure 8:
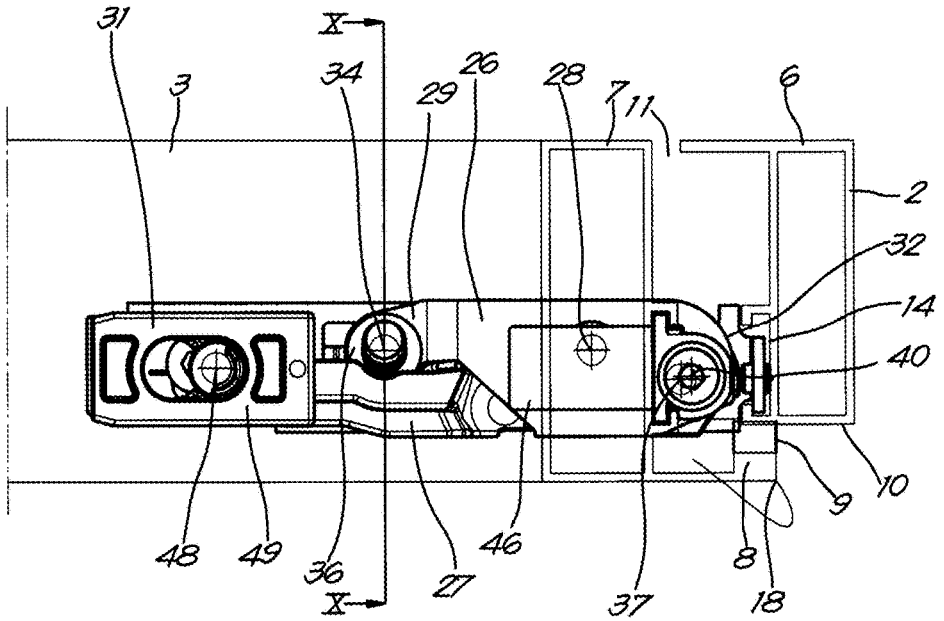
FIG. 8 shows a cross-section according to line VIII-VIII of FIG. 7, but in the tilted state of the window.
Figure 9:
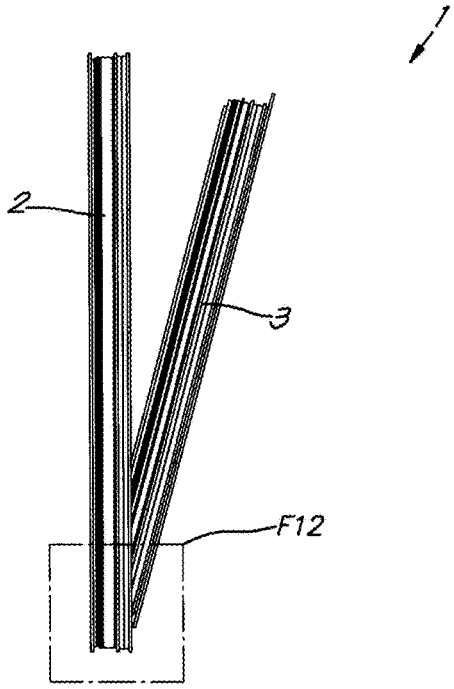
FIG. 9 shows a side view of a turn-tilt window according to the invention in the tilted state, but without the top concealed hinge.

The vertical limb 43 is intended to be fastened against the vertical side 13 of the leaf 3 and to this end is provided with a base 44 with edges 45 protruding sideways with which this arm 43, as illustrated in the cross-section of FIG. 8, can be slid in the fitting groove 15 on the vertical side 13 of the leaf 3.

The horizontal limb 46 thereby serves as a stop against the underside of the leaf 3 and thereby fits in the fitting groove 15 on this underside.

The second end 33 of the second arm 27 is provided with a shiftable leaf hinge 47 in the form of a fixed peg 48 on this end 33 of the second arm 27 that is turnably affixed on a slide plate 49 that is intended to be shiftably affixed in the fitting groove 15 on the underside of the leaf 3.

Figure 6:
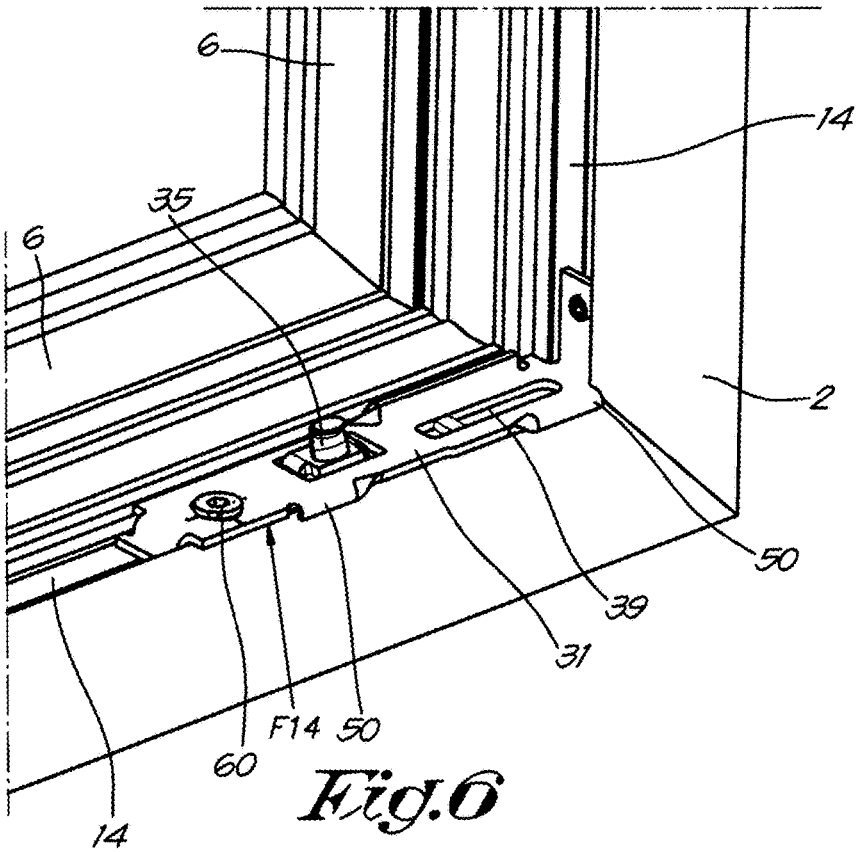
FIG. 6 shows the mounting slat as indicated by arrow F6 in FIG. 5, in the mounted state in an inside corner of the fixed frame.
Figure 7:
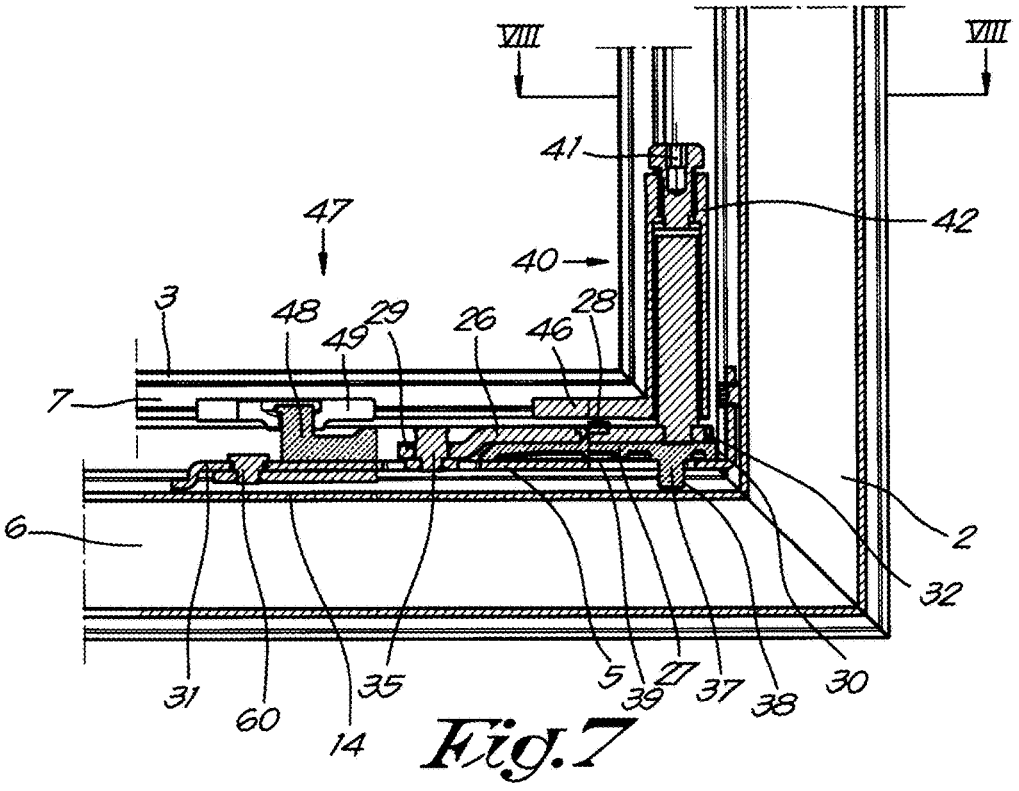
FIG. 7 shows a cross-section according to line VII-VII of FIG. 1, but in a mounted and closed state of the window.

The mounting slat 31 is mounted on the fixed frame 2 over the horizontal fitting groove 14 of the fixed frame 2, as shown in FIG. 6, preferably by simply hooking in the mounting slat, whereby according to a specific aspect this mounting slat is held fast to the fixed frame 2 without the action of any screw.

The mounting slat 31 is provided on its front edge with a rounded tilting edge 50 around which the scissors can hinge in their closed state of FIG. 8 in order to enable a tilting movement of the leaf 3 around the horizontal tilting axis Y-Y' that coincides with this tilting edge 50.

When tilting open the leaf 3 the peg 35 of the mounting slat 31 forms a tilting guide for the eye 36 of the first end of the first arm 26 of the scissors 25.

Figure 10:
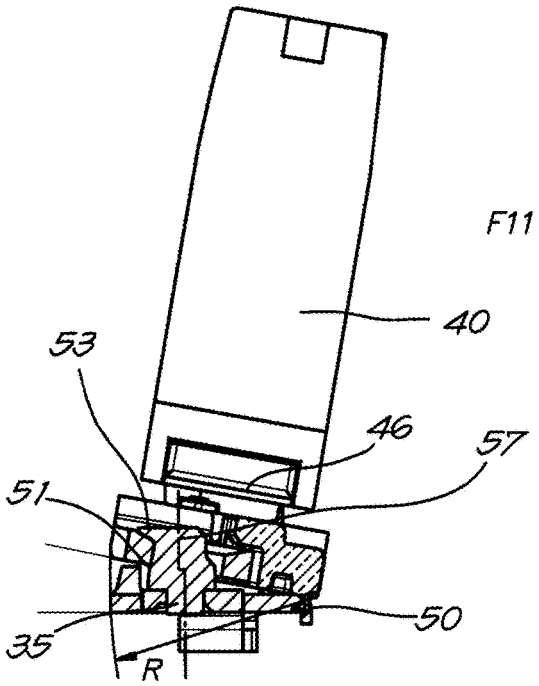
FIG. 10 shows a cross-section according to line X-X of FIG. 8, but for the unmounted hinge of FIG. 8.
Figure 11:
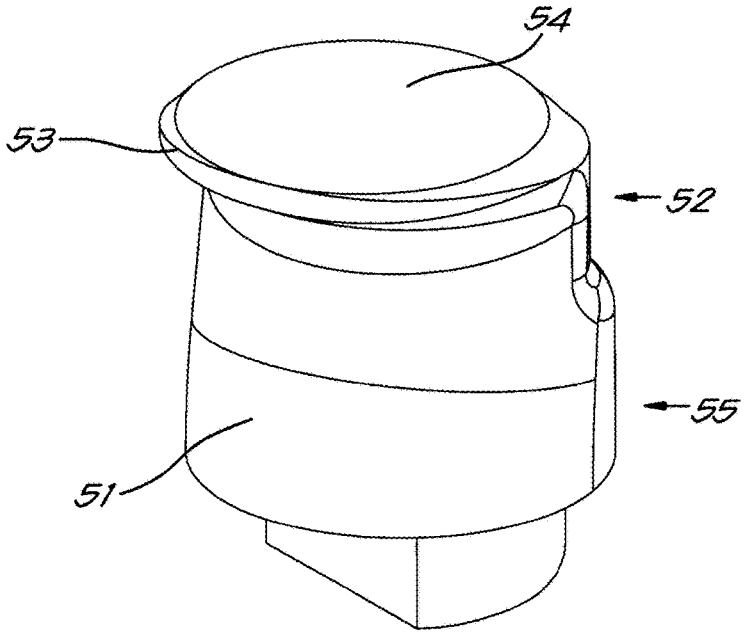
FIG. 11 shows a perspective view of the peg that is indicated by F11 in FIG. 10 on a larger scale.

To this end, this peg 35 is provided on the opposite side of the tilting edge 50 with a bend 51 on the outer surface, as shown in the cross-section of FIG. 10 and in FIG. 11 on a larger scale, whereby the bend 51 essentially has a curved form with a radius of curvature R with its centre located on the aforementioned tilting edge 50 of the mounting slat 31.

At the head of the peg 35, a projection 53 is provided that protrudes backwards with respect to the bend 51, in other words oriented away from the tilting edge 50.

In the example, the projection 53 at the head 52 of the peg 35 is formed by a disc 54 that is displaced eccentrically backwards with respect to the base of this peg 35.

The disc 54 at the head 52 of the peg 35 preferably has a round form with a diameter that is equal to or somewhat smaller than the inside diameter of the eye 36, which in turn has an inside diameter that essentially corresponds to the outside diameter of the base 55 of the peg 35.

As can be seen in FIG. 5, the mounting slat 31 with the peg 35 is constructed as a separate component of the bottom concealed hinge 5 that can be coupled to the scissors 25 of the hinge by hooking the peg 38 of the shiftable frame hinge 37 in the guide slot 39 of the mounting slat 31 and hooking the eye 36 over the head 52 of the peg 35 of the mounting slat 31, with the scissors 25 in the open position.

However, this is only possible with these scissors 25 in a position as shown in FIG. 5 with the arms 26 and 27 of the scissors 25 parallel to the top surface 56 of the mounting slat 31, as shown in FIG. 5, whereby the eye can only be hooked over the peg 35 in one direction perpendicular to the aforementioned top surface. Once the eye has passed by the collar, the eye can be slid with a forward movement under the projection 53 over the base 55 of the peg 35.

This hooking movement of the eye 36 over the peg 35 is shown in FIG. 10 by the jagged movement line 57 of the centre of the eye 36.

In the same way the eye 36 can only be unhooked with an opposite movement of the peg 35, in other words only with the scissors 25 if parallel to the top surface 56 of the mounting slat 31.

Figure 12:
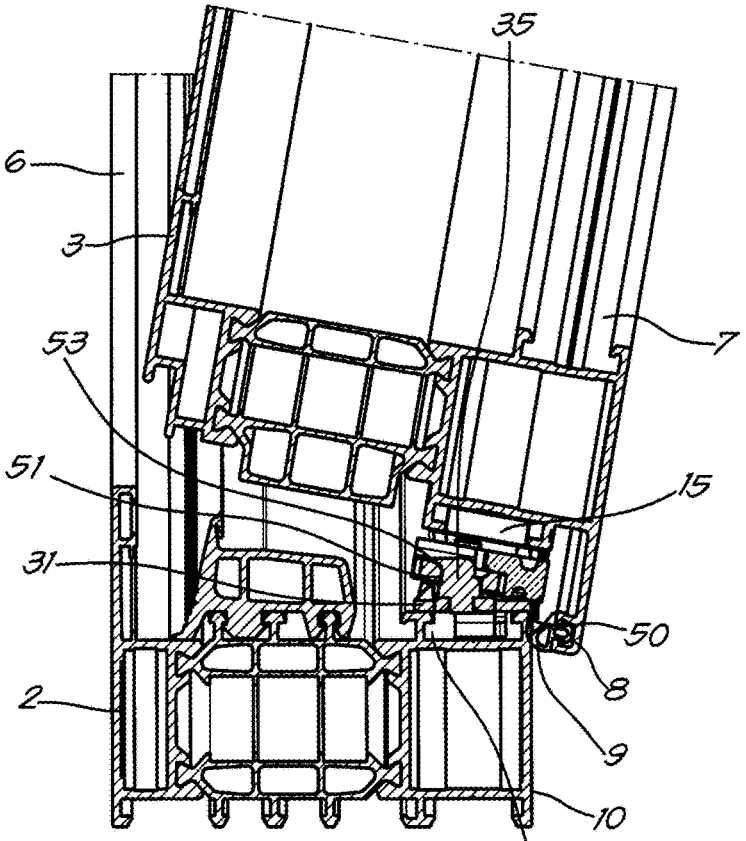
FIG. 12 shows a cross-section such as that of FIG. 10, but this time with the concealed hinge in the mounted state.

Once the leaf 3 is mounted in the frame 2, the leaf 3 can hinge around the tilting edge 50 up to the tilt position that is shown in FIGS. 10 and 12, whereby the projection 53 serves as a stop for the hinge movement of the eye 36 around the tilting edge 50 and thereby determines the maximum tilt opening of the window 1.

Figure 13:
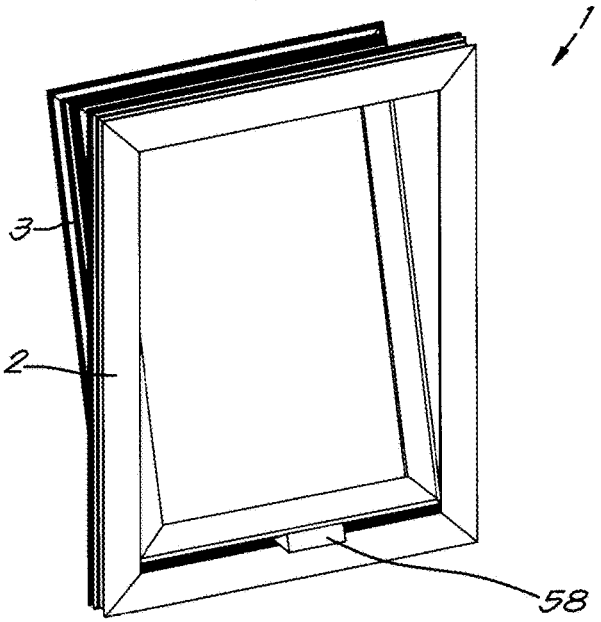
FIG. 13 shows a tilted open window during a break-in attempt.

In this tilted position it is not possible to lift the leaf 3 out of the frame 2 by means of a wedge 58, as illustrated in FIG. 13, that is driven between the leaf 3 and the frame 2. Indeed, the projection 53 prevents the leaf 3 from being able to be driven further upwards.

The form of the peg 35 with bend 50 and projection 53 can of course also be applied to a bottom concealed hinge with a horizontal tilting axis Y-Y' that is not necessarily realised by a tilting edge 50, as described above, but which for example is realised in a more conventional way by a shaft of the bottom hinge itself or by a deformation of the arms or similar. In such a case, the radius of curvature R of the bend 51 is measured from a centre located on the aforementioned tilting axis that does not necessarily coincide with a tilting edge of the mounting slat.

According to a particular aspect of the invention the mounting slat 31 is constructed of two parts with a basic part 31*a* that is intended to be mounted on the fixed frame 2 and a part 31*b* that is shiftable with respect to this basic part 31*a* on which the aforementioned peg 35 is fastened by riveting, welding, pressing or any other fastening method, so that by shifting the shiftable part 31*b*, the peg 35 also shifts with respect to the basic part 31*b*.

The mounting slat 31 is provided with a adjuster 60 for adjusting the position of the shiftable part 31*b* with the peg 35 in the longitudinal direction Z-Z' of the mounting slat 31 for the sideways adjustment of the position of the leaf 3 with respect to the frame 2.

This adjuster 60 can take on any form and enables the peg 35 to be set to the desired longitudinal position and to be fixed in this position with respect to the basic part 31*b*.

It is specific that the shiftable part 31*b* of the mounting slat 31 is provided with an end stop 61 for the movement of the peg 38 of the shiftable frame hinge 37 in the guide slot 39 in the basic part 31*b* when turning the leaf 3 open.

This end stop is at a fixed distance from the peg 35 and extends in the guide slot 39.

Figure 14:
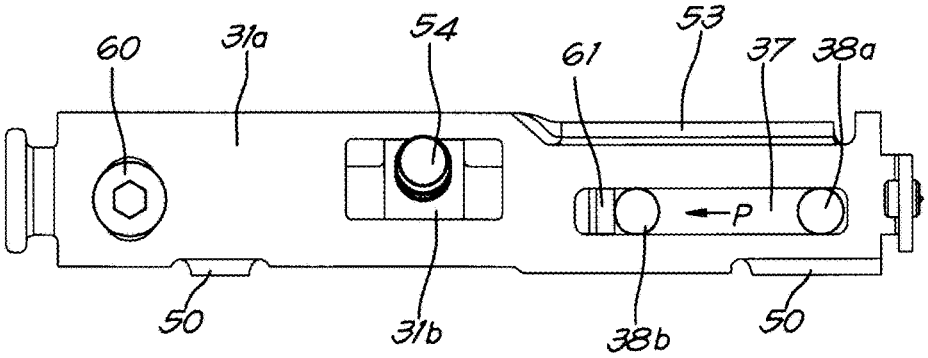
FIG. 14 shows a top view of the mounting slat that is indicated by F14 in FIG. 6.
Figure 15:
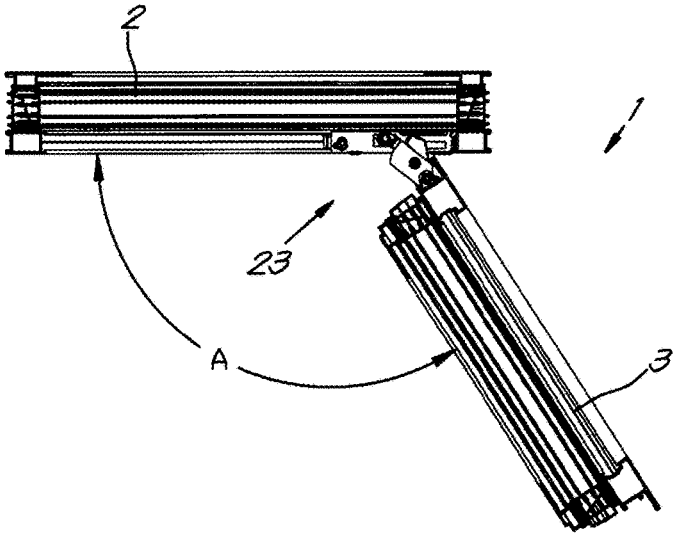
FIG. 15 shows a cross-section such as that of FIG. 8, but in a turned open state.

FIG. 14 shows the position of the peg 38 in the guide slot 39 in two positions, i.e. a position 38*a* corresponding to a closed window 1 and a position 38*b* whereby when turning open the leaf 3 the peg 38 has moved in the guide slot 39 in the direction of arrow P in FIG. 14 up to against the end stop 61, corresponding to the maximum turning opening A of the leaf 3 as shown in FIG. 15.

The adjuster 60 of the shiftable part 31*b* simultaneously determines the position of the peg 35 and the end stop 61 that are thereby moved together by the adjuster 60.

Figure 16:
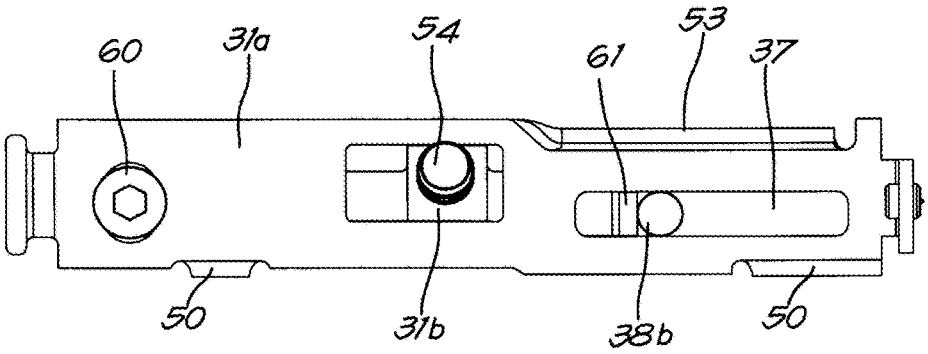
FIG. 16 shows the same view as that of FIG. 14, but in a different position.

FIG. 16 shows the mounting slat 31 with a shiftable part 31*b* that is moved to the right with respect to the situation in FIG. 14 with the adjuster 61.

Thanks to this joint adjustment of the peg 35 and the end stop 61, the maximum opening angle A of the window 1 remains unchanged in the event of a sideways adjustment of the position of the leaf 3 in the frame 2.

The present invention is by no means limited to the embodiment described as an example and shown in the drawings, but a concealed hinge according to the invention and a turn-tilt window equipped therewith can be realised in all kinds of forms and dimensions without departing from the scope of the invention.

The invention claimed is:

1. A concealed hinge for a turn-tilt window with a fixed frame (2) and a turnable leaf (3), the concealed hinge configured for both a turning movement between an open and a closed position about a vertical axis, and a tilting movement between a tilted position and the closed position about a horizontal axis, the concealed hinge (5) comprising:

scissors (25) with a first arm (26) and a second arm (27), the first and second arms (26, 27) being connected together by a central hinge (28), respective first ends (29, 30) of each of the first and second arms being connected by a hinge to a mounting slat (31) that is configured to be mounted horizontally on the fixed frame (2), and each of the first and second arms (26, 27), at respective second ends (32, 33), being provided with a hinge (40, 47) that couple to the leaf (3), wherein the first arm (26) is connected by the first end (29) to the mounting slat (31) by a fixed frame hinge (34) with a first peg (35) that is fastened to the mounting slat (31) and mounted upright substantially parallel to the vertical axis, wherein the second arm (27) is connected by the first end (30) to the mounting slat (31) by a shiftable frame hinge (37) with a second peg (38) that is provided on the first end of the second arm (27) and shiftably affixed in a guide slot (39) of the mounting slat (31), and wherein, when the concealed hinge is turned about the vertical axis to the closed position, the scissors (25) are in a collapsed position and remain in the collapsed position during the tilting movement such that the mounting slat (31) operates as a support for the tilting movement of the scissors (25) and the fixed first peg (35) on the mounting slat (31) forms a guide for the tilting movement.

2. The concealed hinge according to claim 1, wherein the mounting slat (31) is provided along a front edge along the horizontal axis, the front edge forming a tilting edge (50) around which the scissors (25) are configured to tilt in the collapsed position.

3. The concealed hinge according to claim 2, further comprising:

an eye (36) on the first end (29) of the first arm (26) that hooks over the first peg (35).

4. The concealed hinge according to claim 3, wherein the first peg (35) is provided with a bend (51) on a side of the first peg (35) opposite the tilting edge (50), the bend having a curved form with a radius of curvature for guiding the eye (36).

5. The concealed hinge according to claim 4, wherein a projection (53) is provided at a head (52) of the first peg (35) that protrudes to the side of the first peg (35) opposite the tilting edge (50).

6. The concealed hinge according to claim 5, wherein the projection (53) at the head (52) of the first peg (35) on the mounting slat (31) is formed by a disc (54) that is displaced eccentrically with respect to a base (55) of the first peg (35).

7. The concealed hinge according to claim 6, wherein the disc (54) at the head (52) of the first peg (35) of the mounting slat (31) is round and has a diameter equal to or somewhat smaller than the inside diameter of the eye (36).

8. The concealed hinge according to claim 5, wherein the mounting slat (31) with the first peg (35) is a separate component of the concealed hinge that is configured to be coupled to the scissors (25) of the hinge by hooking the second peg (38) of the shiftable frame hinge (37) in the slot (39) of the mounting slat (31) and hooking the eye (36) over the head of the first peg (35) of the mounting slat (31) with the scissors (25) in a position parallel to or slightly tilted with respect to a plane of the mounting slat (31).

9. The concealed hinge according to claim 5, wherein the first peg (35) of the mounting slat (31) and the eye (36) of the first arm (26) of the scissors (25) are such that the eye (36) cannot be detached from the first peg (35) of the mounting slat (31) when the concealed hinge (5) is in a mounted state with the scissors (25) in the collapsed position and in the tilted position due to the presence of the projection (53) at the head (52) of the first peg (35).

10. The concealed hinge according to claim 1, wherein the mounting slat (31) is constructed of two parts with a fixed part (31*a*) that is configured to be mounted on the fixed frame (2) and an adjustable part (31*b*) of the mounting slat (31) that is shiftable with respect to the fixed part (31*a*), the first peg (35) of the mounting slat (31) extending from the adjustable part (31*b*).

11. The concealed hinge according to claim 10, wherein the mounting slat (31) is provided with an adjuster (60) that adjusts the position of the first peg (35) in the longitudinal direction of the mounting slat (31) via the adjustable part (31*b*) of the mounting slat (31).

12. The concealed hinge according to claim 10, wherein the adjustable part (31*b*) of the mounting slat (31) is provided with an end stop (61) for movement of the second peg (38) of the shiftable frame hinge (37) in the guide slot (39) in the fixed part (31*a*) of the mounting slat (31) during the turning movement.

13. The concealed hinge according to claim 12, wherein the end stop (61) is shiftably held in the guide slot (39).

14. The concealed hinge according to claim 13, wherein the end stop (61) and the first peg (35) of the mounting slat (31) are connected together at a fixed distance from one another, and the position of both is adjustable together in the longitudinal direction (Z-Z') of the mounting slat (31) by the adjuster (60).

15. The concealed hinge according to claim 12, wherein the end stop (61) is a maximum stop for the open position of the concealed hinge (5).

16. The concealed hinge according to claim 1, wherein the second end (32) of the first arm (26) is provided with a fixed leaf hinge (40) with a fixed shaft (41) around which a fastening body (42) is affixed that is configured to be fastened sideways against the leaf (3) of the window (1), and the second end (33) of the second arm (27) is provided with a shiftable leaf hinge (47) in the form of a fixed peg (48) on the second arm (27) that is turnably affixed to a slide plate (49) that is intended to be shiftably affixed on the leaf (3).

17. A turn-tilt window, comprising:

a fixed frame (2); and a leaf (3) that is turnably and tiltably affixed in the frame (2), wherein the window (1) is provided at a bottom of the leaf (3) with one concealed hinge (5) according to claim 1, the concealed hinge (5) being mounted at the bottom of the leaf (3), and the mounting slat (31) of the hinge (31) being fastened on an inside of the fixed frame (2).

18. The turn-tilt window according to claim 17, wherein the turn-tilt window has a height that is less than 50 cm.

19. The concealed hinge according to claim 6, wherein the first peg (35) of the mounting slat (31) and the eye (36) of the first arm (26) of the scissors (25) are such that the eye (36) cannot be detached from the first peg (35) of the mounting slat (31) when the concealed hinge (5) is in a mounted state with the scissors (25) in the collapsed position in the tilted position due to the presence of the projection (53) at the head (52) of the first peg (35).

20. The concealed hinge according to claim 7, wherein the first peg (35) of the mounting slat (31) and the eye (36) of the first arm (26) of the scissors (25) are such that the eye (36) cannot be detached from the first peg (35) of the mounting slat (31) when the concealed hinge (5) is in a mounted state with the scissors (25) in the collapsed position in the tilted position due to the presence of the projection (53) at the head (52) of the first peg (35).

* * * * *